United States Patent [19]

Daswick

[11] 4,154,859

[45] May 15, 1979

[54] METHOD OF COOKING A MEAT PATTY

[76] Inventor: Alexander C. Daswick, 647 Orange Grove, South Pasadena, Calif. 91030

[21] Appl. No.: 870,295

[22] Filed: Jan. 18, 1978

Related U.S. Application Data

[60] Division of Ser. No. 654,712, Feb. 3, 1976, which is a continuation-in-part of Ser. No. 209,738, Dec. 20, 1971, abandoned.

[51] Int. Cl.[2] ..... B65B 25/22

[52] U.S. Cl. ..... 426/412; 426/92; 426/144; 426/523

[58] Field of Search ..... 426/92, 113, 107, 114, 426/129, 234, 243, 244, 246, 279, 280, 282, 523, 646, 513, 514, 517, 412; 99/372-381, 384

[56] References Cited

U.S. PATENT DOCUMENTS

| | | | |
|---|---|---|---|
| D. 116,174 | 8/1939 | Trabold | D1/26 |
| D. 149,511 | 5/1948 | Mitzel | D1/26 |
| D. 226,595 | 4/1973 | Caunes | D1/26 |
| 1,993,621 | 3/1935 | Parsons | 426/282 |
| 2,633,284 | 3/1953 | Moffett et al. | 426/118 X |
| 2,670,296 | 2/1954 | Tansley | 426/513 |
| 2,686,129 | 8/1954 | Seiferth | 426/113 X |
| 2,838,404 | 6/1958 | Cohen | 426/129 X |
| 2,915,397 | 12/1959 | Telkes | 426/523 X |
| 2,939,793 | 6/1960 | Richman | 99/358 |
| 3,220,856 | 11/1965 | Vischer | 426/113 |
| 3,313,230 | 4/1967 | Simjian | 99/372 |
| 3,863,020 | 1/1975 | Robinson | 426/646 X |
| 3,978,238 | 8/1976 | Frey | 426/523 |

*Primary Examiner*—Steven L. Weinstein
*Attorney, Agent, or Firm*—Gene W. Arant

[57] ABSTRACT

The method of cooking a meat patty by first forming it so that its central part is only about half the thickness of its circumferential edge portion, and applying heat only to the circumferential edge.

1 Claim, 2 Drawing Figures

METHOD OF COOKING A MEAT PATTY

IDENTIFICATION OF REFERENCED PATENT

The present application is a division of my copending prior application Ser. No. 654,712 filed Feb. 3, 1976 which is a continuation-in-part of Ser. No. 209,738, filed Dec. 20, 1971, now abondoned. The entire drawings and specification of the patent are incorporated herein by reference in order to provide a full and complete disclosure of the present invention.

SUMMARY OF THE INVENTION

The present invention pertains to a method of cooking a meat patty. More particularly the invention pertains to a method of cooking a meat patty comprising, shaping the meat patty so that the top and bottom surfaces are convexly formed and the thickness of the center portion thereof is about one-half that of its peripheral portions, placing the meat patty in a metal foil container whose top and bottom walls are shaped to conform substantially to the configuration of the meat patty, pressing the container walls tightly against the circumferential wall of the meat patty and applying heat only to the circumferential wall of the container.

An object and purpose of the present invention is to provide a method to cook and serve a food product much nearer to the point of consumption, specifically, to provide a method to legally cook a hamburger sandwich at a highly portable facility, such as a catering truck, and then immediately serve it to the customer for purpose of eating.

A further object of the present invention is to provide a meat product which can be cooked more uniformly and efficiently, and which is capable of retaining flavorings normally lost as a result of substantial evaporation of cooking gases.

DRAWING SUMMARY

FIGS. 1 and 2 herein, corresponding to FIGS. 98 and 99 of my referenced patent, illustrate an embodiment of the invention in which a meat patty is enclosed within a metal foil wrapper conforming to the convexly formed top and bottom surfaces of the meat patty and tightly pressed against the circumferential edge of the meat patty, and thereafter heat energy is transmitted through the circumferential wall of the container for the purpose of cooking the meat patty therewithin.

DETAILED DESCRIPTION

Figure 1:
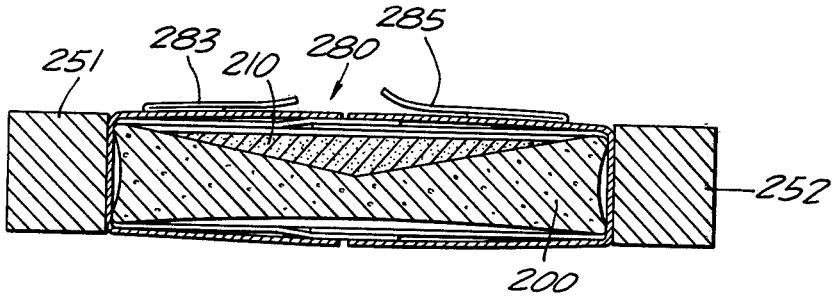
Figure 2:
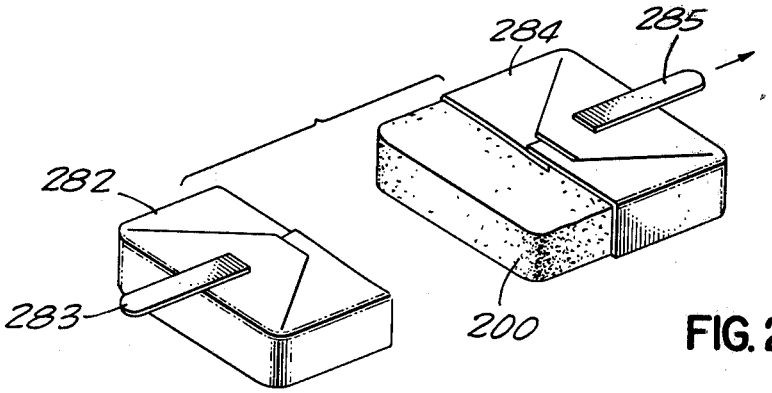

More specifically, a meat patty 200 is of a generally square or rectangular configuration. It is shaped so that its bottom wall or surface has an upwardly convex curvature while its top wall or surface has a downwardly convex curvature. These depressions in the opposite surfaces of the meat patty are sufficiently deep so that at its central portion it has a thickness of about half the thickness of its peripheral portions.

A quantity of sauce 210 is placed within the depression formed in the upper surface of the meat patty 200.

A metal foil container 280 is placed about the meat patty. The metal foil container has top and bottom walls which are shaped to conform substantially to the configuration of the meat patty.

According to the invention the container walls are pressed tightly against the circumferential wall of the meat patty, and heat is then applied only to the circumferential wall of the container. In the illustrated embodiment the application of heat is accomplished by a parallel pair of heated metal jaws 251, 252, which engage parallel and opposing sides of the exterior wall of the metal foil container 280.

Thus the cooking of the meat patty 200 is accomplished by heat energy which flows radially inward towards its thinner central portion.

What is claimed is:

1. The method of cooking a meat patty having upper and lower surfaces and a circumferential wall, comprising the steps of:

shaping the meat patty by progressively thinning the patty at both its upper and lower surfaces from its peripheral portions to its central part so that the central part is about half the thickness of its peripheral portions;

placing the meat patty in a metal foil container whose top and bottom walls are shaped to conform substantially to the configuration of the meat patty;

pressing the circumferential wall of the container against the circumferential wall of the meat patty; and applying heat to the circumferential wall, only, of the container so as to transmit heat energy through the container and into the meat patty until the meat patty is cooked.

* * * * *